United States Patent [19]

Sippel et al.

[11] Patent Number: 4,870,905

[45] Date of Patent: Oct. 3, 1989

[54] SPIN STABILIZED PROJECTILE

[75] Inventors: Achim Sippel; Heinz-Josef Kruse, both of Ratingen; Klaus D. Karius, Jüchen, all of Fed. Rep. of Germany

[73] Assignee: Rheinmetall GmbH, Düsseldorf, Fed. Rep. of Germany

[21] Appl. No.: 213,606

[22] PCT Filed: Nov. 3, 1987

[86] PCT No.: PCT/EP87/00662

§ 371 Date: Jun. 30, 1988

§ 102(e) Date: Jun. 30, 1988

[87] PCT Pub. No.: WO88/05899

PCT Pub. Date: Aug. 11, 1988

[30] Foreign Application Priority Data

Jan. 31, 1987 [DE] Fed. Rep. of Germany ..... 3702866

[51] Int. Cl.[4] ..... F42B 31/00

[52] U.S. Cl. ..... 102/524; 102/501

[58] Field of Search ..... 102/526, 527, 524, 517

[56] References Cited

U.S. PATENT DOCUMENTS 1,529,664 3/1925 Moriarty ..... 102/526
2,454,801 11/1948 Himmer ..... 102/526
4,242,961 1/1981 Moredock et al. ..... 102/527
4,552,071 11/1985 Horais et al. ..... 102/527

*Primary Examiner*—David H. Brown
*Attorney, Agent, or Firm*—Spencer & Frank

[57] ABSTRACT

A spin stabilized projectiles (1) having a rotating band (3) arranged on the shell body (2), with such rotating band being provided with grooves (35, 36, 37) to receive rotating band material sheared off toward the rear during passage of the projectile (1) through a gun barrel (4) so that the transfer of spin is effected with the aid of annular rotating band zones (31, 32, 33, 34) which form spin transfer ring. The diameter (38) of at least one spin transfer ring (31, 34), preferably the rearmost ring, is larger than the diameter (45) of the rifling grooves (42) in the gun barrel (4). Due to the high radial pressure on the shell body in the region of the rotating band, great radial deformations may occur, particularly in thin-walled shell bodies. The consequences are untightness of the rotating band and too much stress on the projectile. To overcome these drawbacks of prior art rotating bands, the diameter (39) of at least one of the remaining spin transfer rings (32, 33) is smaller than the diameter of the rifling grooves (45) but larger than the caliber (44) of the gun barrel (4).

9 Claims, 1 Drawing Sheet

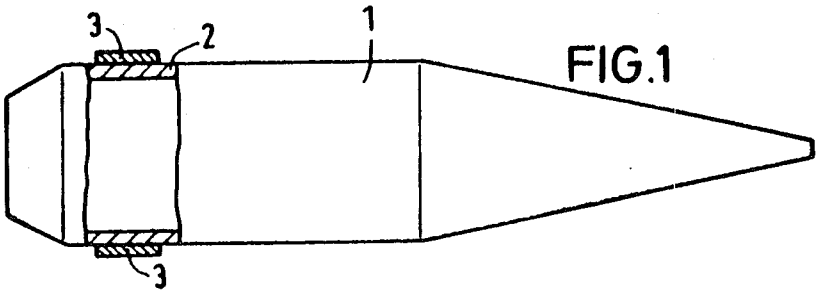
FIG.1
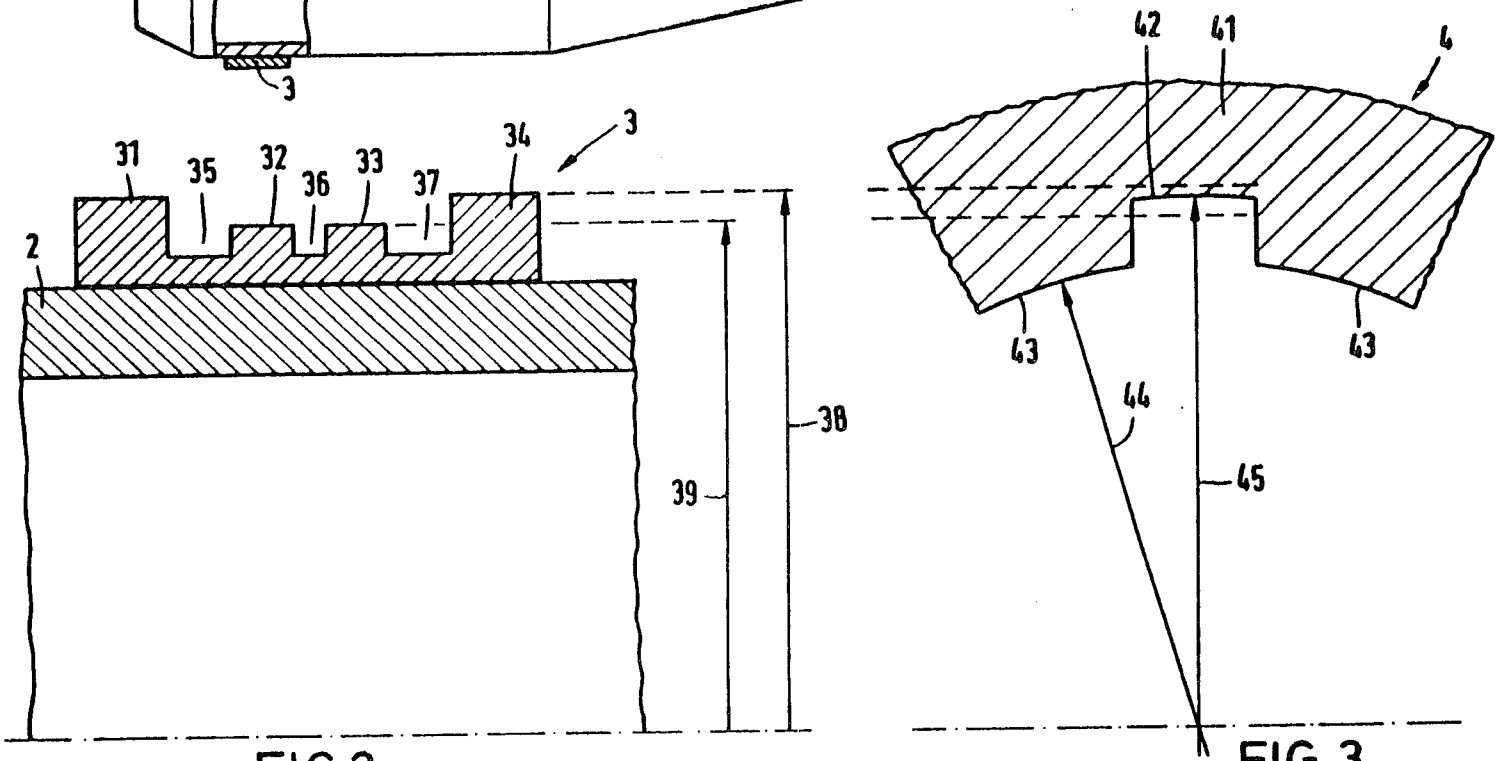
FIG.2
FIG.3

SPIN STABILIZED PROJECTILE

BACKGROUND OF THE INVENTION

The invention relates to a spin stabilized projectile having a rotating band disposed on the shell body, with the rotating band, in order to receive the rotating band material sheared off toward the rear when the projectile passes through a gun barrel, being provided with grooves so that the spin is transferred with the aid of annular rotating band zones (spin transfer rings), and with the diameter of at least one spin transfer ring being larger than the diameter of the rifling grooves of the gun barrel.

In spin stabilized projectiles, the projectiles are equipped, in order to transfer the spin, with one or sometimes, for reasons of stress and deformation, also with a plurality of rotating bands arranged one behind the other (spin transfer rings). The rotating bands have such diameters that, during passage of the projectile through the gun barrel, they pass themselves into the rifling grooves. It is known to provide circumferential grooves in the rotating band to receive the rearwardly sheared off rotating band material (see, for example, U.S. Pat. No. 3,910,194). The rotating bands are generally made of copper, soft iron or plastic.

With these prior art rotating bands, radial contact between the gun barrel and the rotating band is established only by way of the spn transfer rings. This contact produces a radial pressure on the shell body (rotating band pressure). Particularly if thin shell bodies are employed in which the ratio of the wall thickness of the shell body to the caliber of the gun barrel is usually less than or equal to 0.05, the projectile reacts with particular sensitivity to radial pressure since at locations which depend on the geometry of the projectile there may be great stresses on the material. This may cause, inter alia, the shell body to be pressed inwardly and the seal against the propellant gases customarily provided by the rotating band is no longer ensured.

SUMMARY OF THE INVENTION

It is therefore the object of the present invention to provide a spin stabilized projectile of the above-mentioned type in which, primarily with the use of very thin-walled bodies, the shell body is stress relieved in the region of the rotating bands and thus experiences low radial deformation while simultaneously ensuring spin transfer.

This object is accomplished according to the invention by a spin stabilized projectile having a rotating band disposed on the shell body with the rotating band, in order to receive the rotating band material sheared off toward the rear when the projectile passes through a gun barrel, being provided with a plurality of circumferential grooves so that the spin is transferred with the aid of a plurality of annular rotating band zones (spin transfer rings); and wherein: the diameter of the rearmost spin transfer ring is larger than the diameter of the rifling grooves of the gun barrel; and the diameter of at least one of the remaining spin transfer rings is smaller than the diameter of the rifling grooves but larger than the caliber of the gun barrel.

The invention is thus based on the idea of providing spin transfer rings in the rotating band to produce a seal against the propellant gases and creating spin transfer rings which serve merely to transfer spin and thus perform a pressure relief function as a result of the missing radial contact between the ring surface and the bottom of the rifling grooves in the gun barrel. These spin transfer rings are able to act as a seal only in the region of the lands in the gun barrel.

BRIEF DESCRIPTION OF THE DRAWINGS

The invention will be described in greater detail below with reference to an embodiment and with the aid of drawing figures wherein:

It is shown in:

FIG. 1 shows a prior art projectile equipped with a rotating band according to the invention;

FIG. 2 is a detail view of a rotating band according to the invention disposed on the shell body; and FIG. 3 is a partial cross-sectional view of a gun barrel equipped with rifling grooves and lands to illustrate the invention.

DETAILED DESCRIPTION OF THE PREFERRED EMBODIMENT

In FIG. 1, a spin stabilized projectile is marked 1, the shell body is marked 2 and the rotating band is marked 3. Rotating band 3 is dimensioned to have such a diameter that during passage of the projectile through the gun barrel, the band presses itself fully into the rifling grooves. By way of the track guidance of the rifling grooves, the band transmits spin to the projectile and simultaneously produces a seal against the powder gases.

In FIG. 2 there is shown an enlargement of the shell body, again marked 2, on which the rotating band 3 according to the invention is disposed. As a whole, rotating band 3 is provided with four spin transfer rings marked 31, 32, 33 and 34. Between spin transfer rings 31 to 34 there are disposed grooves 35, 36 and 37. These grooves 25-37 serve in a known manner to receive the rotating band material sheared off during passage of the shell body through the gun barrel. Radial contact between the gun barrle and the rotating band 3 exists only at the spin transfer rings 31 to 34.

The outer diameter of spin transfer rings 31 and 34 is marked 38 and the outer diameter of spin transfer rings 32 and 33 is marked 39.

FIG. 3 is a partial cross-sectional view of a gun barrel 4. Here, the reference numeral 41 identifies the actual metal gun barrel, 42 is a rifling groove worked into the interior wall of the gun barrel and 43 identifies the lands following to the right and left of rifling groove 42. The caliber of gun barrel 4, which is measured between opposing lands, is marked 44 and the diameter between opposing rifling grooves is marked 45.

According to the invention, the diameters 39 of spin transfer rings 32 and 33 are selected to be smaller than diameter 45 but larger than the caliber 44 of the gun barrel 4. Thus, due to the lack of radial contact between the ring surface and the bottom of the rifling groove in gun barrel 41, these spin transfer rings perform no sealing function. Only in the regions of lands 43 of gun barrel 41 are spin transfer rings 32 and 33 also able to produce a seal. Due to this measure, radial pressure is integrally reduced and consequently also the radial deformation of shell body 2.

The actual seal against the powder gases is produced only by spin transfer rings 31 and 34 which has been found to be sufficient in practice.

We claim:

1. In a spin stabilized projectile having a rotating band disposed on the shell body, wherein, in order to receive the rotating band material sheared off toward the rear when the projectile passes through a gun barrel having rifling grooves, said rotating and is provided with a plurality of circumferential grooves so that the spin is transferred with the aid of annular rotating band zones which form respective spin transfer rings; the improvement wherein: the diameter of the rearmost one of said spin transfer rings is larger than the diameter of the rifling grooves of the gun barrel; and the diameter of at least one of the remaining spin transfer rings is smaller than the diameter of the rifling grooves but larger than the caliber of the gun barrel.

2. A spin stabilized projectile according to claim 3, wherein all remaining of said spin transfer rings between said leading and rearmost spin transfer rings have a diameter which is smaller than the diameter of the rifling grooves but larger than the caliber of the gun barrel.

3. A spin stabilizer projectile according to claim 1, wherein the diameter of the leading one of said spin transfer rings in the direction of flight of the projectile is greater than the diameter of the rifling grooves of the gun barrel.

4. In a spin stabilized projectile having a relatively thin shell body and a rotating band disposed on said shell body adjacent its tail, with said rotating band being provided with a plurality of circumferential grooves which divide the circumferential surface of said rotating band into a plurality of annular spin transfer rings and which receive material of said rotating band sheared off in a rearward direction when the projectile passes through a gun barrel provided with rifling grooves; the improvement wherein: the diameter of the rearmost of said spin transfer rings is larger than the diameter of the rifling grooves of the gun barrel; and the diameter of at least one of the remaining said spin transfer rings is smaller than the diameter of the rifling grooves but larger than the caliber of the gun barrel.

5. A spin stabilized projectile according to claim 4, wherein said rearmost spin transfer ring is disposed at the rera edge of said rotating band.

6. A spin stabilized projectile as defined in claim 4, wherein the diameter of the leading one of said spin transfer rings in the direction of flight of the projectile is greater than the diameter of the rifling grooves of the gun barrel.

7. A spin stabilized projectile as defined in claim 6, wherein all remaining of said spin transfer rings between said leading and rearmost spin transfer rings have a diameter which is smaller than the diameter of the rifling grooves but larger than the caliber of the gun barrel.

8. A rotating band for a spin stabilized projectile to be fired from a rifled gun barrel comprising: an annular band of metal to be disposed on the shell body of a projectile; a plurality of grooves formed in the circumferential surface of said band and dividing said circumferential surface into a plurality of annular zones which form respective annular spin transfer rings; and wherein the diameter of each of the two outermost of said spin transfer rings is larger than the diameter of the rifling grooves of the gun barrel, and the diameter of at least one of the remaining of said plurality of spin transfer rings is smaller than the diameter of the rifling grooves of the gun barrel but larger than the caliber of the gun barrel.

9. A rotating band according to claim 8, wherein the diameter of all of said remaining of said plurality of spin transfer rings is smaller than the diameter of the rifling grooves of the gun barrel but larger than the caliber of the gun barrel.

* * * * *